US011548710B2

(12) United States Patent
Tramontana et al.

(10) Patent No.: US 11,548,710 B2
(45) Date of Patent: Jan. 10, 2023

(54) BREAK-OPEN SINGLE-DOSE PACKAGES

(71) Applicant: Contract Pharmaceuticals Limited, Mississauga (CA)

(72) Inventors: Matthew J. Tramontana, Pennington, NJ (US); Stephen E. Simantiras, Randolph, NJ (US); Michael Quinn, East Hanover, NJ (US); Tor Alden, Basking Ridge, NJ (US)

(73) Assignee: Contract Pharmaceuticals Limited, Mississauga (CA)

( * ) Notice: Subject to any disclaimer, the term of this patent is extended or adjusted under 35 U.S.C. 154(b) by 45 days.

(21) Appl. No.: 17/263,393

(22) PCT Filed: Apr. 15, 2020

(86) PCT No.: PCT/IB2020/000292

§ 371 (c)(1),
(2) Date: Jan. 26, 2021

(87) PCT Pub. No.: WO2020/212757

PCT Pub. Date: Oct. 22, 2020

(65) Prior Publication Data

US 2021/0163201 A1 Jun. 3, 2021

Related U.S. Application Data

(60) Provisional application No. 62/964,958, filed on Jan. 23, 2020, provisional application No. 62/925,510,
(Continued)

(51) Int. Cl.
*B65D 75/32* (2006.01)
*A61J 1/03* (2006.01)
(Continued)

(52) U.S. Cl.
CPC ..... *B65D 75/326* (2013.01); *A45D 34/00* (2013.01); *A61J 1/035* (2013.01); *A61J 1/1443* (2013.01);
(Continued)

(58) Field of Classification Search
CPC ..... A61J 1/1443; A61J 1/035; A45D 34/00; B65D 83/0055; B65D 75/58; B65D 75/326
(Continued)

(56) References Cited

U.S. PATENT DOCUMENTS 4,140,409 A 2/1979 DeVries
4,236,652 A 12/1980 Beguhn
(Continued)

FOREIGN PATENT DOCUMENTS

CN 200971216 Y 11/2007
EP 2628691 A1 8/2013
WO WO-2009040629 A2 4/2009

OTHER PUBLICATIONS

"Simple, unit-dose package Patent-protected East-open Technology", www.slideshare.net/yettco/snap-and-snapplicator-12671308, Oct. 20, 2016, 3 pages.
(Continued)

*Primary Examiner* — Chun Hoi Cheung
(74) *Attorney, Agent, or Firm* — Harness, Dickey & Pierce, P.L.C.

(57) ABSTRACT

A break-open single-dose package includes a panel defining a frangible region, one or more sheets coupled to the panel and defining a pocket therebetween for storing a spreadable consumable, and an applicator. The frangible region is adapted to form an opening through which the spreadable consumable can exit in response to folding of the panel. The applicator includes a backing and a vessel extending from
(Continued)

the backing. The vessel defines a channel for receiving any spreadable consumable that exits the pocket. The applicator is positioned adjacent to the frangible region for permitting a user to spread on a surface any spreadable consumable that exits the pocket using the applicator without requiring the user's hand(s) to contact the spreadable consumable. The backing is configured to move with the panel and separate from the vessel in response to folding of the panel. Other example packages and/or applicators are also disclosed.

32 Claims, 7 Drawing Sheets

Related U.S. Application Data filed on Oct. 24, 2019, provisional application No. 62/834,111, filed on Apr. 15, 2019.

(51) Int. Cl.
*B65D 75/58* (2006.01)
*B65D 83/00* (2006.01)
*A45D 34/00* (2006.01)
*A61J 1/14* (2006.01)

(52) U.S. Cl.
CPC ..... *B65D 75/325* (2013.01); *B65D 75/58* (2013.01); *B65D 83/0055* (2013.01); *A45D 2200/05* (2013.01); *A45D 2200/10* (2013.01)

(58) Field of Classification Search
USPC ..... 401/132–133; 206/229
See application file for complete search history.

(56) References Cited

U.S. PATENT DOCUMENTS 4,430,013 A * 2/1984 Kaufman ..... A61M 35/003 401/133
4,493,574 A 1/1985 Redmond et al.
4,812,067 A 3/1989 Brown et al.
5,395,031 A 3/1995 Redmond
6,041,930 A 3/2000 Cockburn
6,945,391 B2 9/2005 Moodie
7,121,409 B1 10/2006 Hamilton et al.
7,506,762 B2 3/2009 Nelson et al.
7,955,018 B2 * 6/2011 Abergel ..... A45D 40/261 401/126
8,113,730 B2 * 2/2012 Maloney ..... B05C 1/00 206/229
8,225,932 B2 7/2012 Burattini
8,366,337 B2 * 2/2013 Maloney ..... B05C 1/00 206/229
8,591,130 B2 11/2013 Koptis et al.
8,651,761 B2 2/2014 Maloney et al.
8,662,349 B2 3/2014 Genosar et al.
8,709,099 B2 4/2014 Littig et al.
8,714,855 B2 * 5/2014 Littig ..... C11D 17/049 401/133
8,919,594 B2 12/2014 Teys
10,549,873 B2 * 2/2020 Hashimoto ..... B65D 83/00
2005/0178086 A1 8/2005 Bakken
2007/0138204 A1 * 6/2007 Chen ..... A45D 34/04 222/106
2009/0074502 A1 * 3/2009 Maloney ..... B05C 1/00 401/133
2010/0065582 A1 3/2010 Nelson et al.
2010/0166485 A1 * 7/2010 Jemsby ..... B65D 75/30 401/6
2010/0264044 A1 * 10/2010 Beihoffer ..... A45D 34/04 206/204
2015/0157839 A1 6/2015 Bansal et al.
2015/0298844 A1 10/2015 Burattini
2016/0375233 A1 12/2016 Tidwell et al.
2018/0002044 A1 1/2018 Rutter et al.

OTHER PUBLICATIONS http://www.tapemark.com/snap.html, 2016, 1 page.
"Topical Drug Delivery", http://www.tapemark.com/snapplicator-and-snap/, 2016, 3 pages.

* cited by examiner

BREAK-OPEN SINGLE-DOSE PACKAGES

CROSS-REFERENCE TO RELATED APPLICATIONS

This application claims the benefit and priority of U.S. Provisional Application No. 62/834,111, filed Apr. 15, 2019, U.S. Provisional Application No. 62/925,510, filed Oct. 24, 2019, and U.S. Provisional Application No. 62/964,958, filed Jan. 23, 2020. The entire disclosure of each of the above applications is incorporated herein by reference.

FIELD

The present disclosure relates to break-open single-dose packages.

BACKGROUND

This section provides background information related to the present disclosure which is not necessarily prior art.

Various types of storage vessels exist for storing dispensable substances such as medicated creams, gels, lotions, etc. In some cases, a storage vessel may include a rigid or semi-rigid panel and a flexible sheet sealed to the panel to define a pocket between the panel and the flexible sheet for storing the dispensable substance. The panel includes one or more scored lines on one or both sides of the panel. When the storage vessel is folded or otherwise manipulated by a user, the scored line(s) may break allowing the dispensable substance to exit the pocket and pass through the panel. The user may then dispense the stored substance onto a person's skin.

SUMMARY

This section provides a general summary of the disclosure, and is not a comprehensive disclosure of its full scope or all of its features.

According to one aspect of the present disclosure, a break-open single-dose package includes a panel defining a frangible region, one or more sheets coupled to the panel and defining a pocket therebetween for storing a spreadable consumable, and an applicator. The frangible region is adapted to form an opening through which the spreadable consumable can exit in response to folding of the panel. The applicator includes a backing and a vessel extending from the backing. The vessel defines a channel for receiving any spreadable consumable that exits the pocket. The applicator is positioned adjacent to the frangible region for permitting a user to spread on a surface any spreadable consumable that exits the pocket using the applicator without requiring the user's hand(s) to contact the spreadable consumable. The backing is configured to move with the panel and separate from the vessel in response to folding of the panel.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding (but not necessarily identical) parts and/or features throughout the several views of the drawings.

DETAILED DESCRIPTION

Figure 1:
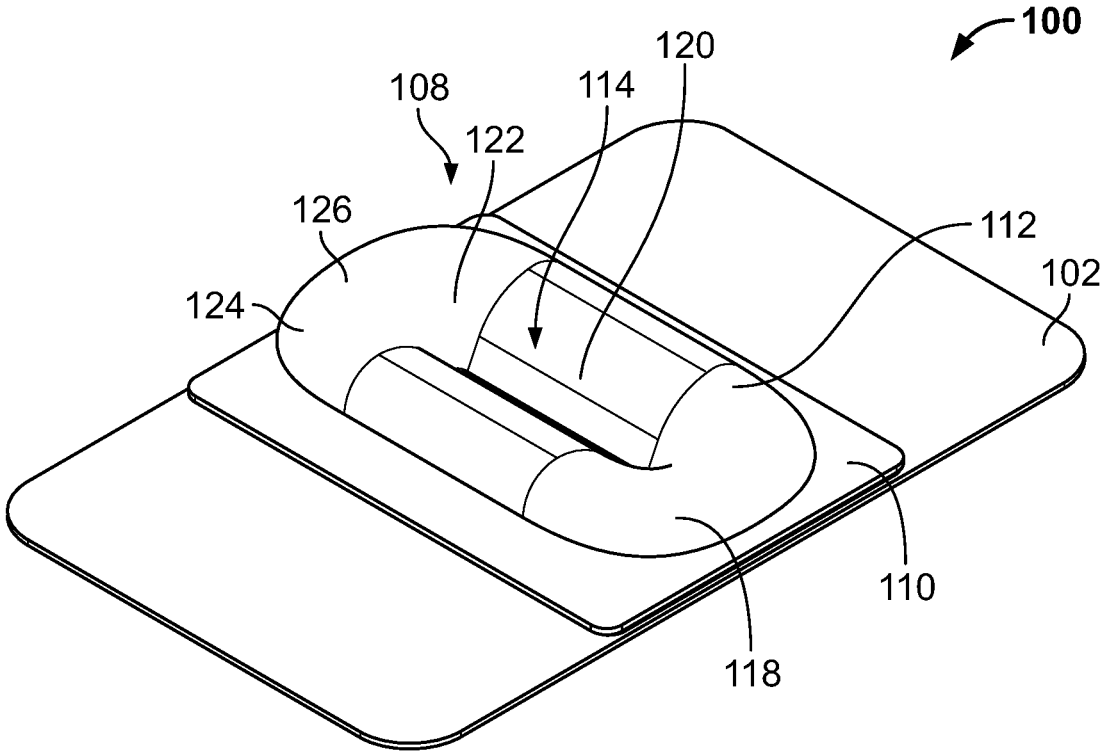
FIG. 1 is an isometric view of a break-open single-dose package having a cup-shaped applicator according to one example embodiment of the present disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments will now be described more fully with reference to the accompanying drawings.

A break-open single-dose package according to one example embodiment of the present disclosure is illustrated in FIGS. 1-6, and indicated generally by reference number 100. As shown in FIGS. 1-6, the break-open single-dose package 100 includes a panel 102 defining a frangible region 104, a sheet 106 coupled to the panel 102 and defining a pocket therebetween for storing a spreadable consumable 132, and an applicator 108 positioned adjacent to the frangible region 104. The frangible region 104 forms an opening through which the spreadable consumable 132 can exit in response to folding of the panel 102. As shown, the applicator 108 includes a backing 110 and a vessel 112 extending from the backing 110. The vessel 112 defines a channel 114 for receiving any spreadable consumable 132 that exits the pocket. The applicator 108 permits a user to spread on a surface any spreadable consumable 132 that exits the pocket using the applicator 108 without requiring the user's hand(s) to contact the spreadable consumable 132.

Figure 5:
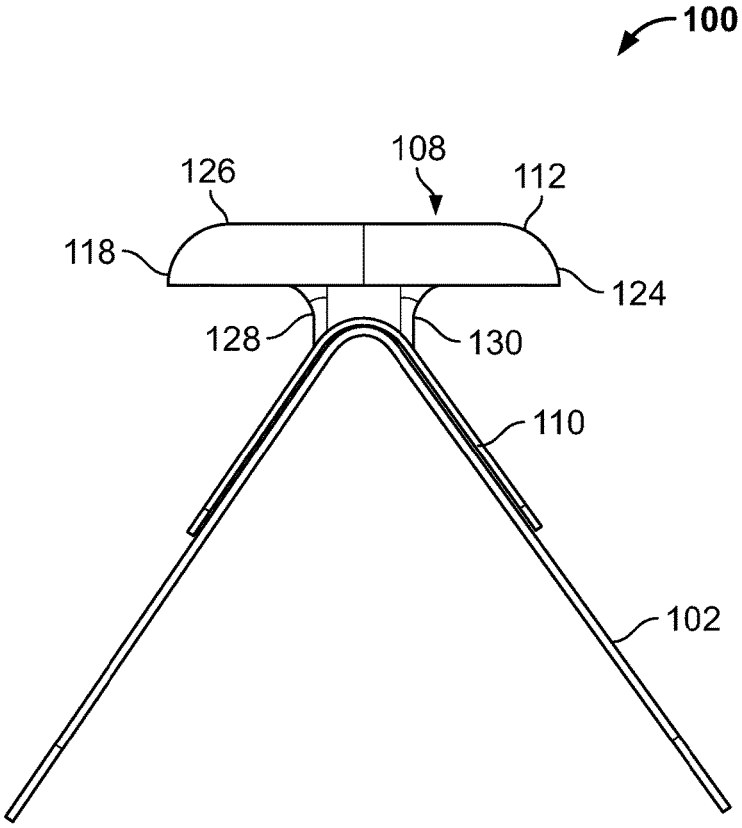
FIG. 5 is a right side view of the package of FIG. 1 with the package in its folded position.

As shown in FIG. 5, the backing 110 moves with the panel 102 in response to folding of the panel 102. This allows the backing 110 to separate from the vessel 112. As such, the vessel 112 becomes at least somewhat isolated from the rest of the package 100. As a result, the user may grasp the panel 102 and use the vessel 112 to apply and spread on a surface the spreadable consumable 132 that exits the pocket without requiring the user's hand(s) to contact the spreadable consumable 132. In some examples, and as further explained below, the vessel 112 may remain substantially stationary and maintain its shape when the panel 102 is folded and the backing 110 is moved as shown in FIG. 5. In other examples, the vessel 112 may move causing the vessel 112 to slightly deform when the backing 110 is moved and separated from the vessel 112, as further explained below.

The backing 110 may be coupled to the panel 102. For example, the backing 110 may be coupled to the panel 102 via adhesive (e.g., an acrylic adhesive tape and/or another suitable adhesive), one or more mechanical devices (e.g., clamps, clips, etc.), etc.

Figure 2:
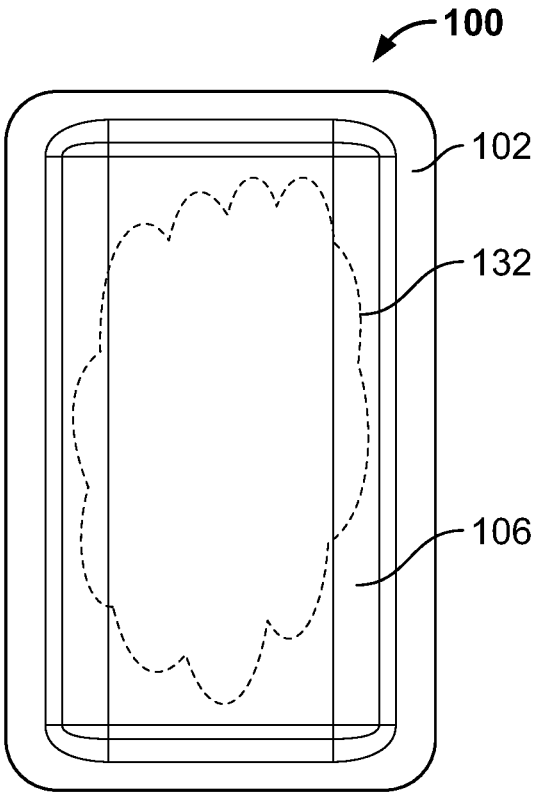
FIG. 2 is a bottom side view of the package of FIG. 1.
Figure 3:
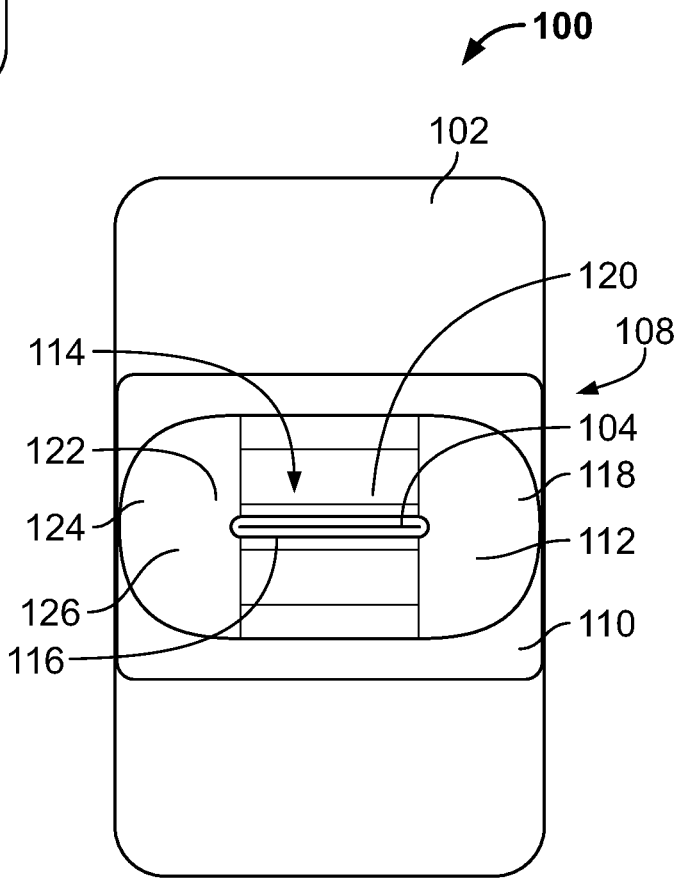
FIG. 3 is a top side view of the package of FIG. 1.
Figure 6:
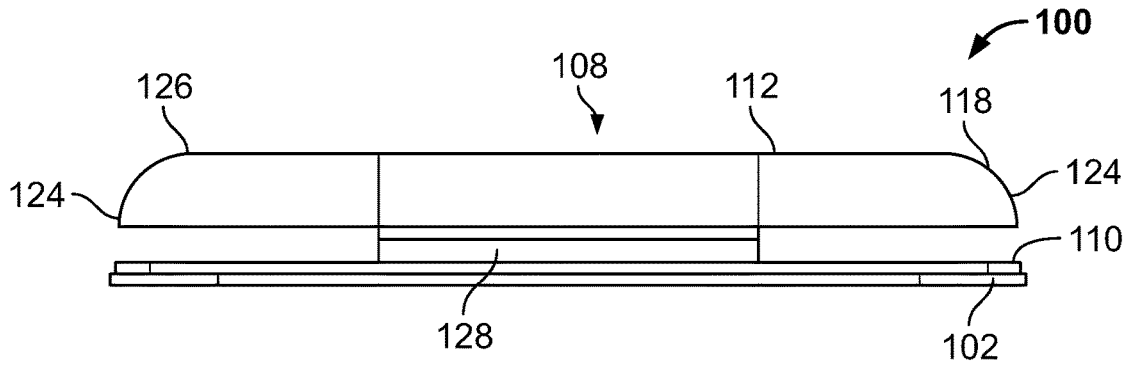
FIG. 6 is a back side view of the package of FIG. 1.

In the example of FIGS. 1-6, the backing 110 extends across the panel 102. In some examples, the backing 110 may extend (e.g., in one direction) across the entire width of the panel 102, and extend (e.g., in another direction) less than the entire length of the panel 102, as shown in FIGS. 3 and 6. For example, and as shown in FIG. 3, the backing 110 may extend the same distance as the panel 102 along the X-axis (e.g., the horizontal direction with respect to FIG. 3), and extend a distance less than the length of the panel 102 along the Y-axis (e.g., the vertical direction with respect to FIG. 3). In other examples, the backing 110 may extend across the entire panel 102, less than the entire width along the X-axis, etc.

As explained above, the applicator 108 is positioned adjacent to the frangible region 104 in the panel 102. For example, the vessel 112 defines an opening 116 adjacent to the frangible region 104. The opening 116 may be in fluid communication with the channel 114, and/or an inlet of the channel 114. As shown, the vessel 112 defines another opening on the opposing side of the channel 114. This opposing opening may be in fluid communication with the channel 114, and/or an outlet of the channel 114. The opening 116 and the opposing opening of the vessel 112 may be portions of the channel 114, or discrete from (but in fluid communication with) the channel 114. As such, when the panel 102 is folded causing the frangible region 104 to break (as further explained below), the spreadable consumable 132 flows from the pocket through the frangible region's opening and the opening 116, and into the channel 114. The spreadable consumable 132 may exit the channel 114 via the opposing opening (e.g., the outlet). In some examples, the spreadable consumable 132 may be stored in the channel 114 prior to applying, spreading, etc. the spreadable consumable 132.

In some examples, the applicator 108 may entirely cover the frangible region 104. For example, and as shown in FIG. 3, the applicator 108 covers and surrounds the frangible region 104. In such examples, the opening 116 of the vessel 112 may have the same or similar size and configuration of the frangible region 104. For example, and as shown in FIG. 3, the size and shape of the opening 116 corresponds to the size and shape of the frangible region 104. Specifically, the size and shape of the opening 116 ensures the opening 116 covers and surrounds the frangible region 104. In other examples, the frangible region 104 may extend beyond the opening 116 and/or beyond the applicator 108 if desired.

The vessel 112 may include different portions. For example, and as shown in FIGS. 1 and 3-6, the vessel 112 includes a canopy 118 and a funnel 120 adjacent to the canopy 118. In the particular example of FIGS. 1-6, the canopy 118 and the funnel 120 each have an oval shape. In other examples, the canopy 118 and/or the funnel 120 may form another suitable shape such as a rectangular shape, a triangular shape, etc.

As shown in FIGS. 1 and 3-6, the vessel 112 includes an interior wall 122 and an exterior wall 124 coupled to the interior wall 122. The walls 122, 124 define an apex 126 of the vessel 112 therebetween. As shown, the walls 122, 124 extend in an enclosed oval path around the frangible region 104 to create a perimeter of the vessel 112.

In the example of FIGS. 1-6, the interior wall 122 extends between the backing 110 and the apex 126, and flares outwardly to create the oval-shaped funnel 120. In such examples, the interior wall 122 may define at least a portion of or the entire channel 114. The exterior wall 124 extends downwardly away from the apex 126 and towards the backing 110. In some examples, the exterior wall 124 may be spaced apart from the interior wall 122, and the area under the apex 126 may be at least partially hollow. In such examples, at least a portion of the interior wall 122 and at least a portion of the exterior wall 124 define the oval-shaped canopy 118 (e.g., an umbrella-like shape).

In the particular example of FIGS. 1-6, the exterior wall 124 does not contact the backing 110. For example, and as shown, an end of the exterior wall 124 is spaced apart from the backing 110. This configuration reduces the amount of material and costs as compared to other applicators. In other examples, the exterior wall 124 may extend to and/or contact the backing 110 as further explained below.

In some examples, the channel 114 may optionally taper from one side of the vessel 112 to the other side of the vessel 112. For example, and as shown in FIGS. 1 and 3, the channel 114 tapers from the opening adjacent to the outlet of the channel 114 (e.g., an area near the apex 126) to the opening 116 adjacent to the frangible region 104 (e.g., an area adjacent to the backing 110) due to the interior wall 122 flaring outwardly, as explained above. This configuration may promote the spreadable consumable 132 that exits the pocket to enter and spread throughout the vessel 112, allow the user to have increased control over any spreadable consumable passing through the channel 114, increase the volume (and therefore the storage capacity) of the channel 114, etc. as compared to other non-tapering designs.

The vessel 112 of FIGS. 1-6 may extend across the width of the panel 102. For example, and as shown in FIGS. 3 and 6, the vessel 112 has a width substantially equal to the width of the panel 102. In such examples, the vessel's width may be substantially equal to the backing's width. This may maximize the vessel's volume (and therefore the storage capacity) while maintaining the structural integrity of the vessel when, for example, the panel 102 is folded. In other examples, the vessel's width may be more than or less than the width of the panel 102.

As explained above, the vessel 112 separates from the backing 110 when the panel 102 and the backing 110 are moved. For example, the vessel's canopy 118 may be a first distance from the backing 110 before the panel 102 is bent, folded, etc. and a second larger distance from the backing 110 after the panel 102 is bent, folded, etc. In such examples, the vessel 112 may include one or more portions to allow the vessel 112 and the backing 110 to separate. For example, the vessel 112 may optionally include flexible portions 128, 130 positioned on opposing sides of the applicator 108 to assist in separating the vessel 112 and the backing 110. For instance, the panel 102 may fold about an axis as shown in FIG. 5. In such examples, the flexible portion 128 extends in a plane substantially parallel to the axis on one side of the applicator 108, and the flexible portion 130 extends in another plane substantially parallel to the axis on the opposing side of the applicator 108.

Figure 4:
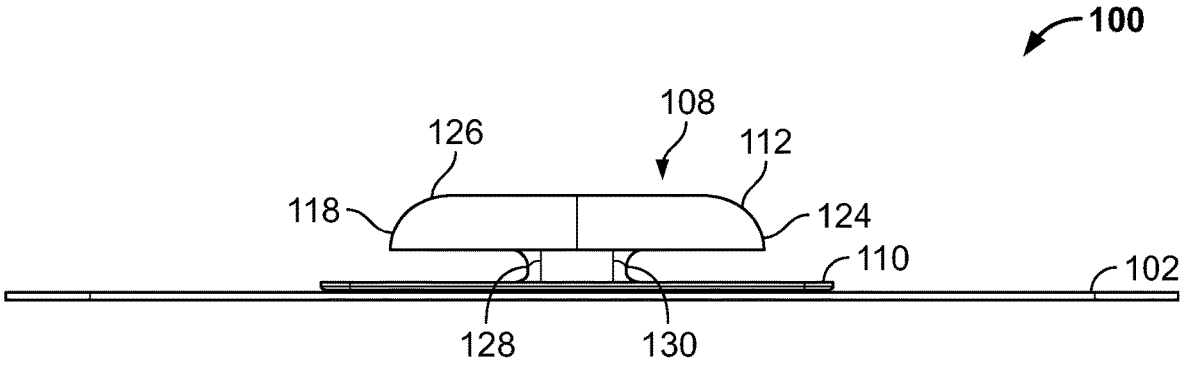
FIG. 4 is a right side view of the package of FIG. 1.

In some examples, the flexible portions 128, 130 may function as a hinge. For example, and as shown in FIG. 4, the vessel 112, the backing 110 and the panel 102 each extend in generally parallel planes when the package 100 is in its unbroken (e.g., static) state. When the panel 102 is folded to break the frangible region 104, the flexible portions 128, 130 flex to allow the backing 110 to move with the panel 102 and separate from the vessel 112, as shown in FIG. 5. In such examples, each side of the backing 110 and the panel 102 may extend in generally parallel planes, while the vessel 112 may extend in a plane generally perpendicular to the backing 110 and the panel 102 when the package 100 is in its folded position. In some examples, the vessel 112 may maintain its substantially oval-shape when the panel 102 is folded (and the backing 110 is moved) due in part to the flexible portions 128, 130. In such examples, the vessel 112 may remain substantially stationary relative to the backing 110.

The flexible portions 128, 130 may extend any suitable distance. For example, and as shown in FIG. 6, the flexible portions 128, 130 extend the width of the vessel's base (e.g., the portion of the vessel 112 coupled to the backing 110). In other examples, the flexible portions 128, 130 may extend more or less that the width of the vessel's base.

Figure 7:
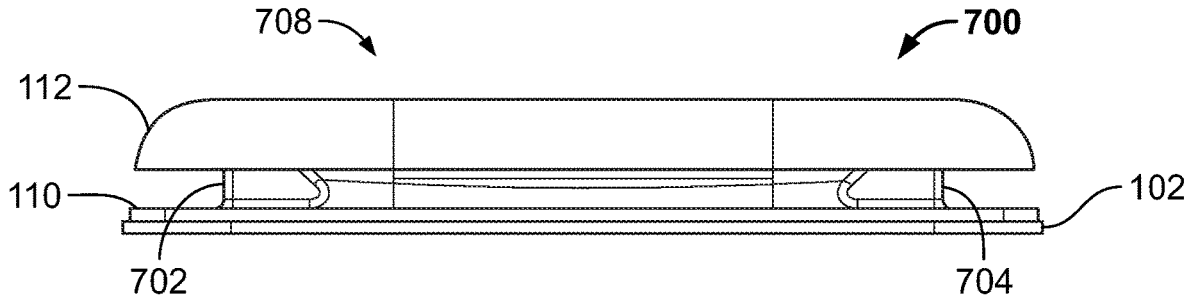
FIG. 7 is a back side view of a break-open single-dose package having a cup-shaped applicator with supports according to another example embodiment.
Figure 8:
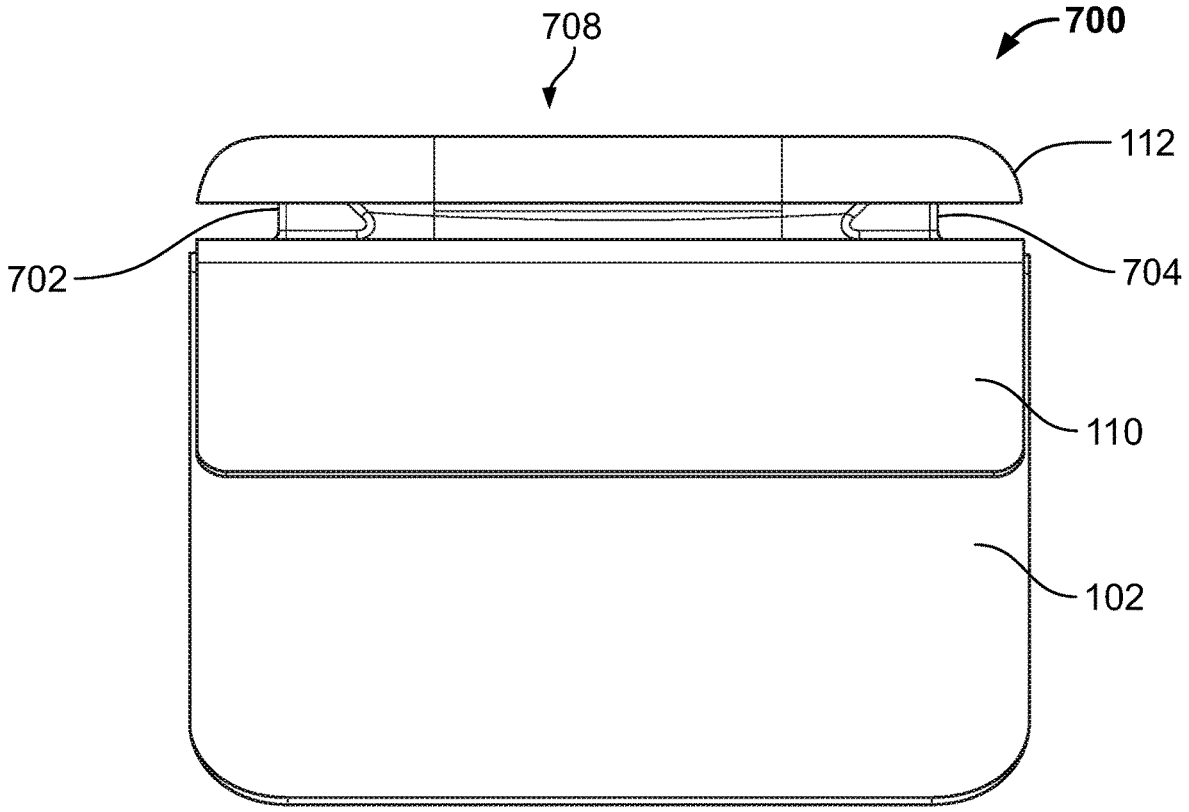
FIG. 8 is a back side view of the package of FIG. 7 with the package in its folded position.

In some examples, the applicators disclosed herein may include one or more optional supports to help maintain the shape, position, etc. of their vessel when a corresponding panel is bent, folded, etc. For example, FIGS. 7 and 8 illustrate a break-open single-dose package 700 substantially similar to the break-open single-dose package 100 of FIGS. 1-6, but including two supports. Specifically, the package 700 of FIGS. 7 and 8 includes an applicator 708, and the panel 102 and the defined pocket of FIGS. 1-6. As shown, the applicator 708 includes the vessel 112 and the backing 110 of FIGS. 1-6, and supports 702, 704 coupled between the backing 110 and the vessel 112.

The supports 702, 704 help maintain the shape of the vessel 112 when the panel 102 is moved and separated from the vessel 112. For example, the supports 702, 704 may be formed of a material having at least some rigidity and/or positioned adjacent to areas of the vessel 112 that are prone to flexing when the panel 102 is folded. This may help support the vessel 112 and prevent the vessel 112 from moving with the backing 110 when the panel 102 is folded, as shown in FIG. 8.

Figure 9:
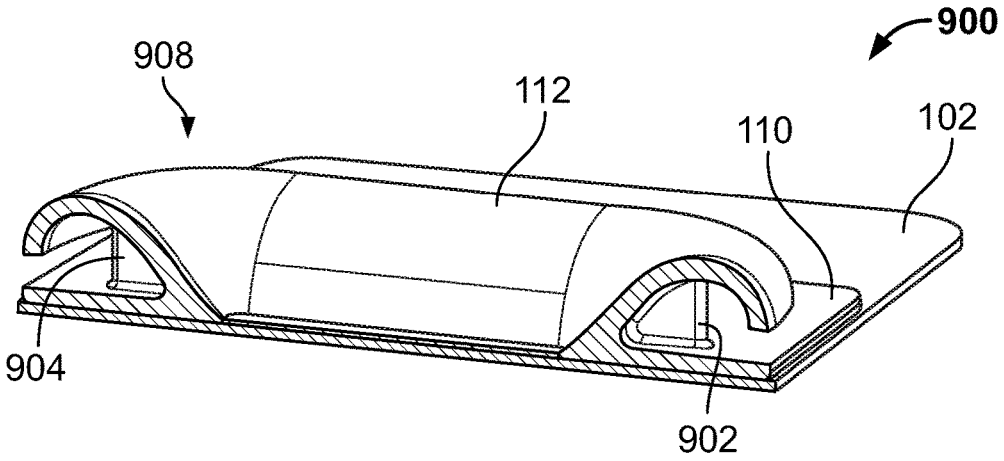
FIG. 9 is a sectional isometric view of a break-open single-dose package having a cup-shaped applicator with multiple supports according to yet another example embodiment.
Figure 10:
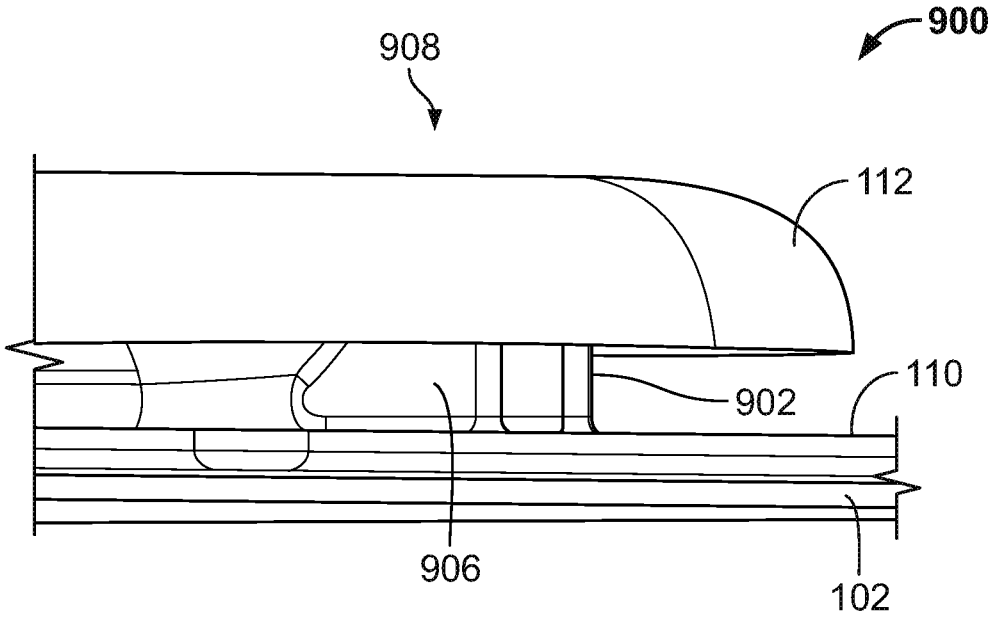
FIG. 10 is an isometric view of a portion of the package of FIG. 9.

In some embodiments, the applicator 708 (and/or any other applicator disclosed herein) may include more than two supports. For example, FIGS. 9 and 10 illustrate portions of a break-open single-dose package 900 similar to the package 700 of FIGS. 7 and 8, but with more four supports. Specifically, the package 900 includes an applicator 908, and the panel 102 and the defined pocket of FIGS. 1-6. The applicator 908 includes the vessel 112 and the backing 110 of FIGS. 1-6, and supports 902, 904, 906 coupled between the backing 110 and the vessel 112. Although not shown, the applicator 908 includes an additional support similar to the support 906, but adjacent to the support 904. Thus, the applicator 908 include four supports coupled between the backing 110 and the vessel 112

In the example of FIGS. 9 and 10, two of the supports (e.g., the supports 902, 906) are positioned on one side of the vessel 112, and other two supports (e.g., the support 904 and the support not shown) are positioned on the opposing side of the vessel 112. As shown, the supports 902, 904, 906 extend from the vessel 112 towards an adjacent edge of the panel 102. In such examples, the supports 902, 904, 906 extend in planes substantially parallel to the panel's folding axis.

Additionally, each set of the supports on the same side of the vessel 112 are spaced apart from each other. For example, and as shown in FIG. 10, the supports 902, 906 are spaced apart from each other. In such examples, the supports 902, 906 may be positioned on opposing sides of the panel's folding axis.

The supports disclosed herein may include any suitable shape. For example, the supports shown in FIGS. 7-10 each may have a triangular shape extending between the backing 110 and the vessel 112. In such examples, each support may include a vertical extending portion between the backing 110 and the vessel 112, a horizontal extending portion positioned along the backing 110, and a diagonal extending portion along the vessel 112. In other examples, one or more of the supports may include another suitable shape, extend in other directions, etc. as desired.

In some examples, any one of the break-open single-dose packages disclosed herein may include one or more optional grips to assist a user in gripping, manipulating, etc. the package. As such, the grips may facilitate user control of the package during handling. In some examples, the grips may be shaped (e.g., contoured, rounded, etc.) and/or sized to facilitate user control. Additionally, the grips may indicate to a user ideal locations for most effectively and efficiently handling the package. The grips may include touchpads, raised portions, etc. as further explained below.

Figure 11:
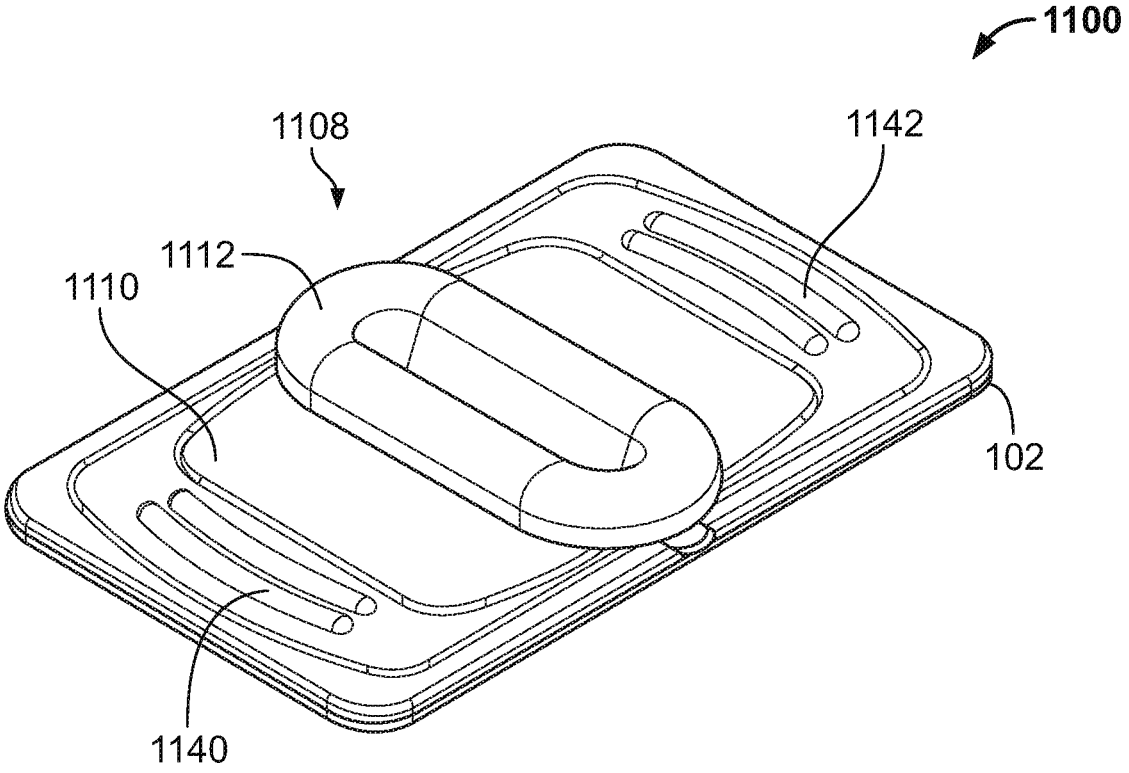
FIG. 11 is an isometric view of a break-open single-dose package having a cup-shaped applicator and grips according to according to another example embodiment.
Figure 12:
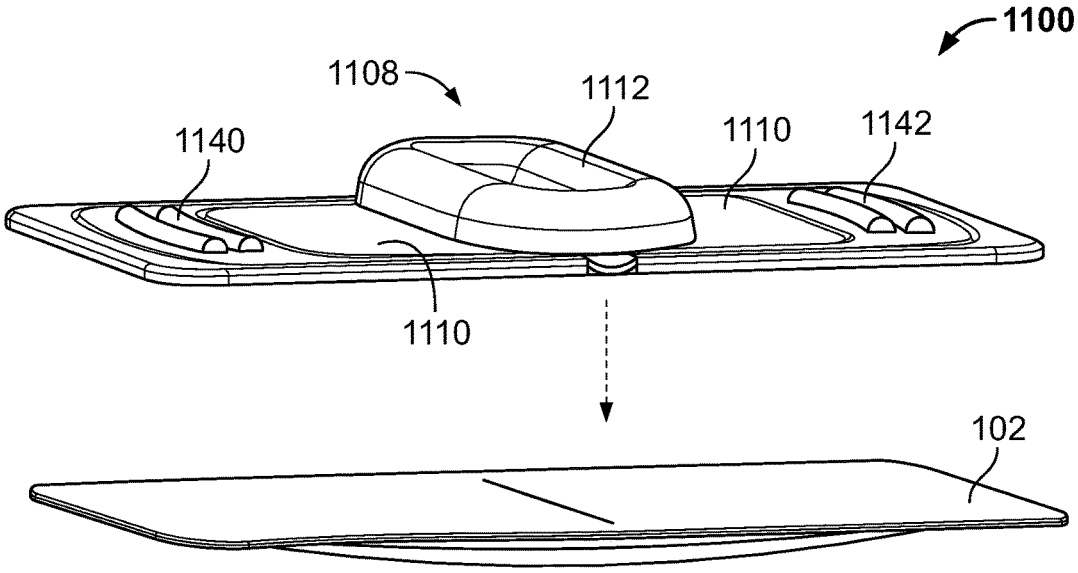
FIG. 12 is an exploded isometric view of the package of FIG. 11.
Figure 13:
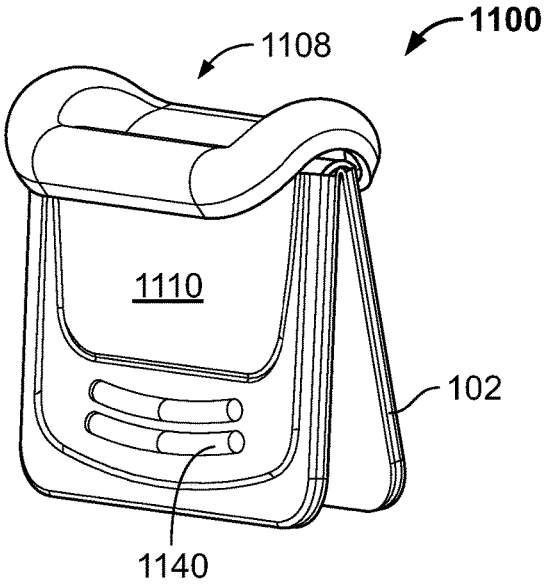
FIG. 13 is an isometric view of the package of FIG. 11 with the package in its folded position.

For example, FIGS. 11-13 illustrate a break-open single-dose package 1100 similar to the package 100 of FIGS. 1-6, but including grips. Specifically, the package 1100 of FIGS. 11-13 includes the panel 102 and the defined pocket of FIGS. 1-6, and an applicator 1108 having grips 1140, 1142.

As shown, the grips 1140, 1142 are positioned on opposing sides of the applicator 1108 to facilitate user control of the package 1100 during handling. In the particular example of FIGS. 11-13, the grips 1140, 1142 are raised portions (e.g., protrusions). Specifically, the grips 1140 include two elongated arc-shaped raised portions on one side of the applicator 1108, and the grips 1142 include two elongated arc-shaped raised portions on the other (opposing) side of the applicator 1108. In other examples, more or less grips on one or both sides of the applicator 1108, different shaped grips, different types of grips, etc. may be employed if desired.

The applicator 1108 includes a backing 1110 and a vessel 1112 coupled to the backing 1110. The backing 1110 and the vessel 1112 of FIGS. 11-13 are similar to the backing 110 and the vessel 112 of FIGS. 1-6. For example, the vessel 1112 includes similar features (e.g., openings, a channel, etc.) and benefits of the vessel 112 of FIGS. 1-6, but has a different shape. For instance, the vessel 1112 includes an exterior wall and an interior wall defining a canopy and funnel portions similar to the vessel 112. However, in the particular example of FIGS. 11-13, the exterior wall of the vessel 1112 extends to the backing 1110.

Additionally, the backing 1110 of FIGS. 11-13 includes similar features and benefits of the backing 110 of FIGS. 1-6, but has a different shape. For instance, the backing 1110 has a substantially trapezoidal shape, whereas the backing 110 has a substantially rectangular shape. In some examples, portions of the backing 1110 may function as grips for users. For example, portions of the backing 1110 adjacent to the grips 1140, 1142 may be touchpads to facilitate user control of the package 1100 as explained herein. In some examples, the portions of the backing 1110 and/or the grips 1140, 1142 may have tactile surfaces (e.g., textured surfaces, tacky surfaces, etc.).

As shown in FIG. 13, the backing 1110 moves with the panel 102 and separates from the vessel 1112. As such, the vessel 1112 becomes at least somewhat isolated from the rest of the package 1100. This may allow the user to grasp the panel 102 and use the vessel 1112 to apply and spread on a surface spreadable consumable that exits the pocket, as explained herein.

In the particular example of FIGS. 11-13, the vessel 1112 may move when the panel 102 is folded. For example, and as shown in FIG. 13, the vessel 1112 may flex and slightly deform when the panel 102 is folded. In such examples, the vessel's openings and channel may to enlarge due to the movement. In some examples, the flexed vessel 1112 of FIG. 13 may allow the user to effectively and efficiently apply surface spreadable consumable located in the vessel's channel.

Figure 14:
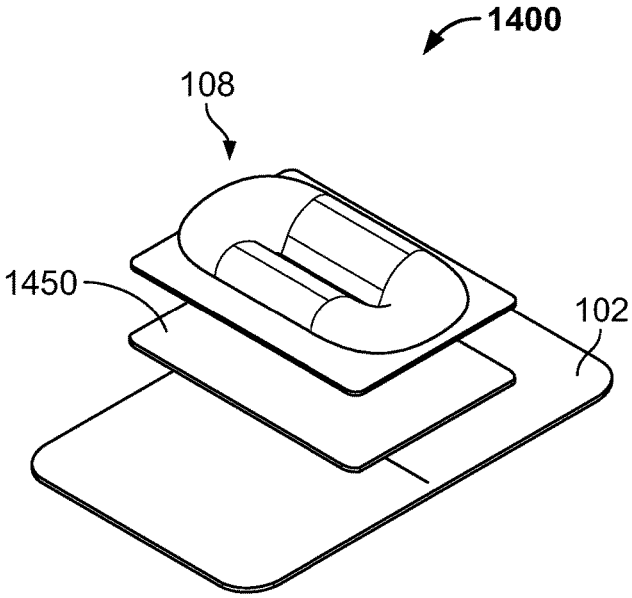
FIG. 14 is an exploded isometric view of a break-open single-dose package having a panel and a cup-shaped applicator coupled to the panel via adhesive tape, according to according to yet another example embodiment.

Any one of the applicators disclosed herein may be coupled to a side of the panel 102 opposing the pocket. Specifically, any one of the applicators may be coupled to the panel 102 via adhesive (e.g., tape such as double sided tape, pressure sensitive adhesive, etc.), one or more mechanical devices (e.g., clamps, clips, etc.), etc. In other examples, the applicators may be coupled to the panel 102 by welding (e.g., ultrasonic welding, vibration welding, etc.) the layers together. For example, FIG. 14 illustrates a break-open single-dose package 1400 including the applicator 108 and the panel 102 of FIGS. 1-6, and adhesive 1450 positioned between the backing 110 and the panel 102 for coupling the applicator 108 and the panel 102. In the particular example of FIG. 14, the adhesive 1450 is an acrylic adhesive tape.

The applicators disclosed herein may be formed of the same material or different materials, one continuous piece of material (e.g., a monolithic construction), separate components coupled together, etc. For example, the backing and the vessel of any one of the applicators may be formed with one continuous piece of material, separate parts of the same material or different materials, etc. In some examples, the vessel, the backing, and the grips are formed out of the same continuous piece of material.

The applicators disclosed herein may be formed of any suitable material. In some examples, the applicators may be formed of flexible materials such as silicone and/or other suitable elastomer materials. In some particular examples, the applicators include a flexible thermoplastic material such as thermoplastic elastomer (TPE). In other examples, the applicators may include another suitable material such as polypropylene (PP), thermoplastic polyurethane (TPU), acrylonitrile butadiene styrene (ABS), etc. In some examples, the material may have a hardness of about 60 shore A to about 80 shore A.

The vessels disclosed herein may have an oval cross-sectional shape. In other examples, any one of the vessels may have another suitable shape such as rectangular, square, circular, trapezoidal, etc. panels, applicators, etc. Additionally, although the panels, applicators, etc. disclosed herein have specific shapes, it should be apparent that any one of the panels, applicators, etc. may have another suitable shape. Further, the panels, applicators, etc. may include generally rounded corners, edges, surfaces, etc. to inhibit poking of a user's skin, to conform to a user's finger, maximize the width of the applicators, etc.

Additionally, the vessels disclosed herein may be flexible. As such, any one of the vessels may flex and conform to a surface when the vessel is pressed against the surface. For example, the vessel may flex allowing at least some portions of the vessel to become substantially flush with the surface. This may allow the user to effectively and efficiently apply the spreadable consumable on the surface.

Any one of the applicators disclosed herein permit a user to apply spreadable consumable on a surface using the applicator without requiring the user's hand(s) to contact the spreadable consumable when using the package. For example, the spreadable consumable may be undesirable or harmful to touch, and/or easier to spread with the applicator than by hand. Thus, a user can dispense the spreadable consumable from the pocket and spread the consumable on a surface using the applicator without coming into contact with the spreadable consumable. As such, the user may spread the spreadable consumable on the surface without contacting the spreadable consumable and/or the surface.

The packages disclosed herein are single-dose packages. For example, in some embodiments the packages may not be reused (e.g., refilled, etc.) after their frangible region is broken. In some examples, the single-dose package includes only one pocket holding a single consumable as shown in FIG. 2. In other examples, the package may include two or more pockets for holding the same or different materials (including, for example, part A and part B of particular medicant or other consumable).

The panels disclosed herein may provide structural integrity to the package. For example, the panels (e.g., support panels) may be substantially rigid structures that provide a user greater ease when grasping, manipulating, etc. the package.

The panels and/or the pockets disclosed herein may be formed of any suitable material. For example, the panels may include plastic, cardboard, silicone, etc. In some examples, the panels and/or the pockets may be formed of various materials to create multilayer configurations. For instance, any one of the panels disclosed herein may include one or more layers (e.g. sheets) of polyethylene terephthalate (PET), polystyrene (PS), aluminum, polyethylene (PE), etc. In some particular examples, the panels may be formed of a PET layer, a PS layer, an aluminum layer, and a PE layer, in that order. In some examples, the panels are rigid or semi-rigid. The pockets may be defined by a single sheet or multiple sheets such as one or more include flexible sheets. In some examples, the sheets may include one or more layers of PET, aluminum, PE, etc. In some particular examples, the sheets defining the pockets may be formed of a PET layer, an aluminum layer, another PET layer and a PE layer, in that order.

The frangible regions disclosed herein form an opening through which the spreadable consumable can exit in response to folding of the panel. For example, and as explained herein, the opening may be formed when the panel is folded, bent, etc. along an axis and away from the applicator. This movement allows portions of the panel to move closer together causing the sealed pocket to fold onto itself thereby applying pressure to the pocket and, in particular, to the frangible region. Because of this pressure, the frangible region may break (e.g., snap, etc.) to form the opening for dispensing the spreadable consumable. In some examples, the frangible region may break when the panel is folded such that the panel's portions are about 90 degrees apart, more or less than 90 degrees apart, etc.

Additionally, the panels may be used to force the spreadable consumables out of the pockets. For example, after the frangible region is broken, a user may fold, bend, etc. (e.g. continue to fold, bend, etc.) the panel with one or both of the user's hand. As a result, a force (e.g., pressure) may be applied to the pocket causing the spreadable consumable to exit the frangible region's opening. In some examples, the force applied to the pocket may be controlled by a user. As such, movement of the panel may form the frangible region's opening and force the spreadable consumable out of the pocket via the opening.

The frangible regions disclosed herein may be formed in various different manners. For example, any one of the frangible regions may be formed by cutting a portion of the panel to form one or more scored lines on one or both sides of the panel, folding the package, deforming the package, etc. In some examples, the panel may be formed of one or more layers of material as explained herein. In such cases, the frangible region may be formed of less layers, a thinner layer, weaker material(s), etc. than other portions of the panel to create the frangible region. In some examples, any one of the panels may include only one frangible region. In other example examples, the panel may include more than one frangible region.

In some examples, the frangible region may be designed to fail before other portions of the package (e.g., the pocket) fail so that the spreadable consumable stored in the pocket can exit the pocket only through the frangible region's opening. For example, the frangible region may be designed to fail (e.g., break, etc.) in response to a force less than the force required to break other portions of the pocket. This can be accomplished by material selection, the manner in which the frangible region is formed, etc.

The spreadable consumable disclosed herein may include various different liquids, creams, ointments, gels, pastes, and/or other suitable spreadable consumable commonly applied to a person's skin. For example, the spreadable consumable may include medicated or non-mediated materials, prescription or non-prescription material(s), etc. In some examples, the spreadable consumable may include an active pharmaceutical ingredient (API). Additionally, the spreadable consumable may have a viscosity ranging between, for example, 2,000 cps and 15,000 cps. In other examples, the spreadable consumable may have a viscosity ranging between, for example, 25,000 cps and 35,000 cps. In some preferred embodiments, the spreadable consumable contained in the pockets (and dispersed) may include testosterone gels, acne medications, sanitizers, cosmetics, lubricants, etc.

In other embodiments, the surface may be part of a food related product, a brick, a piece of wood, a piece of plastic, etc. In such cases, the spreadable consumable may include condiments (e.g., ketchup, barbeque sauce, etc.), caulk, adhesives, and/or other suitable spreadable consumable.

The surfaces disclosed herein may include surfaces of various different objects. For example, a surface may be a person's skin. In such examples, a user can use one of the applicators to spread the spreadable consumable by rubbing the applicator across his/her skin and/or another person's skin without cutting, aggravating, etc. the skin. As such, the packages may be used to apply the spreadable consumable to otherwise sensitive areas. The spreadable consumable may be applied over a large surface area such as the user's shoulder, arm, etc. and/or applied at precise location (e.g., a pimple, a sore, etc.)

The sealable pockets disclosed herein may have any suitable volume. For example, the sealable pockets may have a volume to store between about 0.25 mL and about 1 mL of spreadable consumable. In other examples, the volume may be larger or smaller to store more or less spreadable consumable.

The packages disclosed herein may be sized as desired. For example, any one of the packages may range in size from 40 mm×50 mm to 80 mm×100 mm. In some particular examples, any one of the packages may have an exterior dimension of 43 mm×70 mm, and an interior dimension (e.g., defining its pocket) of 33 mm×60 mm.

In some examples, the packages may be defined by layers of material(s). For example, any one of the packages may include a panel layer defining the panel 102, a pocket layer coupled to the panel layer and defining one or more sealable pockets therebetween, and an applicator layer coupled to the panel layer and defining an applicator (e.g., the applicator 108). In some examples, the packages may be manufactured by coupling the panel layer to the pocket to form the sealable pocket. These layers may form a pack such as an EASYSNAP pack. Additionally, the applicator layer may be coupled to the panel layer on a side opposing of the sealable pocket. It should be understood, however, that references to "layers" herein are not intended to require a particular construction methodology or order.

Although the break-open single-dose packages disclosed herein are shown and/or described as having specific features, it should be apparent that any one or more of the features may be optional. Therefore, any one of the packages disclosed herein and/or another suitable package may include one or more of the optional features without departing from the scope of the disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A break-open single-dose package, comprising:

a panel defining a frangible region;

one or more sheets coupled to the panel and defining a pocket therebetween for storing a spreadable consumable, the frangible region adapted to form an opening through which the spreadable consumable can exit in response to folding of the panel; and an applicator positioned adjacent to the frangible region for permitting a user to spread on a surface any spreadable consumable that exits the pocket using the applicator without requiring the user's hand(s) to contact the spreadable consumable, the applicator including a backing coupled to the panel, a vessel extending from the backing, and one or more supports coupled between the backing and the vessel for maintaining a shape of the vessel when the panel is folded, the vessel defining a channel for receiving any spreadable consumable that exits the pocket, and wherein, in response to folding of the panel, the backing is configured to move with the panel and away from the vessel.

2. The break-open single-dose package of claim 1, wherein the one or more supports each have a triangular shape.

3. The break-open single-dose package of claim 1, wherein the panel is foldable about an axis, and wherein the one or more supports extend in one or more planes substantially parallel to the axis.

4. The break-open single-dose package of claim 3, wherein the one or more supports extend from the vessel towards one or more adjacent edges of the panel.

5. The break-open single-dose package of claim 3, wherein the one or more supports include four supports, wherein two of the supports are positioned on one side of the vessel, and the other two supports are positioned on another opposing side of the vessel.

6. The break-open single-dose package of claim 5, wherein said two of the supports include a first support and a second support spaced apart from each other.

7. The break-open single-dose package of claim 1, wherein the vessel includes a first portion and a second portion adjacent to the first portion, wherein the first portion is shaped as a canopy, and wherein the second portion is shaped as a funnel.

8. The break-open single-dose package of claim 1, wherein the vessel includes a flexible portion, and wherein, in response to folding of the panel, the flexible portion is configured to flex allowing the backing to move with the panel and away from the vessel.

9. The break-open single-dose package of claim 1, wherein the channel is a tapered channel.

10. The break-open single-dose package of claim 1, wherein the vessel includes an interior wall and an exterior wall coupled to the interior wall, and wherein the interior wall and the exterior wall define an apex of the vessel therebetween.

11. The break-open single-dose package of claim 10, wherein a portion of the interior wall and a portion of the exterior wall define a canopy.

12. The break-open single-dose package of claim 10, wherein the exterior wall does not contact the backing.

13. The break-open single-dose package of claim 1, wherein the vessel has a width equal to a width of the panel.

14. The break-open single-dose package of claim 1, wherein the vessel has an oval cross-sectional shape.

15. The break-open single-dose package of claim 1, wherein the applicator includes one or more grips to facilitate user control of the break-open single-dose package during handling.

16. The break-open single-dose package of claim 1, wherein the applicator has a monolithic construction.

17. The break-open single-dose package of claim 1, wherein the applicator includes a thermoplastic material.

18. The break-open single-dose package of claim 1, further comprising a spreadable consumable stored in the pocket.

19. A break-open single-dose package, comprising:

a panel defining a frangible region;

one or more sheets coupled to the panel and defining a pocket therebetween for storing a spreadable consumable, the frangible region adapted to form an opening through which the spreadable consumable can exit in response to folding of the panel; and an applicator positioned adjacent to the frangible region for permitting a user to spread on a surface any spreadable consumable that exits the pocket using the applicator without requiring the user's hand(s) to contact the spreadable consumable, the applicator including a backing coupled to the panel and a vessel extending from the backing, the vessel including a flexible portion and defining a channel for receiving any spreadable consumable that exits the pocket, and wherein, in response to folding of the panel, the flexible portion is configured to flex allowing the backing to move with the panel and away from the vessel.

20. The break-open single-dose package of claim 19, wherein the applicator includes one or more supports coupled between the backing and the vessel for maintaining a shape of the vessel when the panel is folded, wherein the panel is foldable about an axis, and wherein the one or more supports extend in one or more planes substantially parallel to the axis.

21. The break-open single-dose package of claim 20, wherein the one or more supports include four supports, wherein two of the supports are positioned on one side of the vessel, and the other two supports are positioned on another opposing side of the vessel.

22. The break-open single-dose package of claim 19, wherein the vessel includes a canopy shaped portion and a funnel shaped portion, and wherein the funnel shaped portion of the vessel at least partially defines the channel.

23. The break-open single-dose package of claim 19, wherein the vessel has an oval cross-sectional shape.

24. The break-open single-dose package of claim 19, wherein the applicator includes one or more grips to facilitate user control of the break-open single-dose package during handling.

25. The break-open single-dose package of claim 19, further comprising a spreadable consumable stored in the pocket.

26. A break-open single-dose package, comprising:

a panel defining a frangible region;

one or more sheets coupled to the panel and defining a pocket therebetween for storing a spreadable consumable, the frangible region adapted to form an opening through which the spreadable consumable can exit in response to folding of the panel; and an applicator positioned adjacent to the frangible region for permitting a user to spread on a surface any spreadable consumable that exits the pocket using the applicator without requiring the user's hand(s) to contact the spreadable consumable, the applicator including a backing coupled to the panel and a vessel extending from the backing, the vessel defining a tapered channel for receiving any spreadable consumable that exits the pocket, and wherein, in response to folding of the panel, the backing is configured to move with the panel and away from the vessel.

27. The break-open single-dose package of claim 26, wherein the vessel includes a canopy shaped portion and a funnel shaped portion, and wherein the funnel shaped portion of the vessel at least partially defines the tapered channel.

28. The break-open single-dose package of claim 27, wherein the applicator includes one or more supports coupled between the backing and the vessel for maintaining a shape of the vessel when the panel is folded, wherein the panel is foldable about an axis, and wherein the one or more supports extend in one or more planes substantially parallel to the axis.

29. The break-open single-dose package of claim 28, wherein the vessel includes a flexible portion, and wherein, in response to folding of the panel, the flexible portion is configured to flex allowing the backing to move with the panel and away from the vessel.

30. The break-open single-dose package of claim 29, wherein the applicator includes one or more grips to facilitate user control of the break-open single-dose package during handling.

31. The break-open single-dose package of claim 26, wherein the vessel has an oval cross-sectional shape.

32. The break-open single-dose package of claim 26, further comprising a spreadable consumable stored in the pocket.

* * * * *